US010714842B2

(12) United States Patent
Takeuchi et al.

(10) Patent No.: US 10,714,842 B2
(45) Date of Patent: Jul. 14, 2020

(54) ELECTRICAL CONNECTION ASSEMBLY AND METHOD FOR MANUFACTURING SAME

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shunya Takeuchi, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/482,518

(22) PCT Filed: Jan. 16, 2018

(86) PCT No.: PCT/JP2018/000932
§ 371 (c)(1),
(2) Date: Jul. 31, 2019

(87) PCT Pub. No.: WO2018/142913
PCT Pub. Date: Aug. 9, 2018

(65) Prior Publication Data

US 2020/0014123 A1 Jan. 9, 2020

(30) Foreign Application Priority Data

Feb. 2, 2017 (JP) ..... 2017-017816

(51) Int. Cl.
*H01R 4/02* (2006.01)
*H01R 13/405* (2006.01)
*H01R 43/02* (2006.01)

(52) U.S. Cl.
CPC ..... *H01R 4/023* (2013.01); *H01R 13/405* (2013.01); *H01R 43/02* (2013.01); *H01R 4/02* (2013.01)

(58) Field of Classification Search
CPC ..... H01R 4/02; H01R 4/023; H01R 43/02
See application file for complete search history.

(56) References Cited

U.S. PATENT DOCUMENTS 5,541,365 A * 7/1996 Sugiura ..... B23K 26/06 174/94 R
6,027,009 A 2/2000 Shinchi
(Continued)

FOREIGN PATENT DOCUMENTS

JP 5-206627 8/1993
JP 11-8037 1/1999
(Continued)

OTHER PUBLICATIONS

International Search Report dated Mar. 27, 2018.

*Primary Examiner* — Tho D Ta
(74) *Attorney, Agent, or Firm* — Gerald E. Hespos; Michael J. Porco; Matthew T. Hespos

(57) ABSTRACT

An electrical connection assembly and a connection method enable conductors of first and second wires (10A, 10B) to be connected by a simple structure. The electrical connection assembly has first and second wires (10A, 10B) and first and second terminals (20A, 20B) corresponding to the first and second wires (10A, 10B). First and second connecting members (70A, 70B) made of solder are fixed to wire connection surfaces (27*a*) of the first and second terminals (20A, 20B), and an insulating housing holds the terminals.
(Continued)

The first connecting member (70A) includes a bulging portion (72A) bulging from the wire connection surface (27*a*) of the first terminal (20A) and to be connected electrically to the conductor of the second wire (10B).

15 Claims, 18 Drawing Sheets

(56) References Cited

U.S. PATENT DOCUMENTS

| | | | |
|---|---|---|---|
| 6,167,616 | B1 | 1/2001 | Shinchi |
| 2011/0034084 | A1 | 2/2011 | Hsueh et al. |

FOREIGN PATENT DOCUMENTS

| | | |
|---|---|---|
| JP | 11-45744 | 2/1999 |
| JP | 2007-215847 | 8/2007 |
| JP | 2010-146939 | 7/2010 |
| JP | 4681910 | 11/2011 |

* cited by examiner

ELECTRICAL CONNECTION ASSEMBLY AND METHOD FOR MANUFACTURING SAME

BACKGROUND

Field of the Invention

The invention relates to an electrical connection assembly used in an automotive vehicle or the like and a method for manufacturing the same.

Related Art

A known wiring member used in an automotive vehicle or the like has a flat shape, and wires are arranged in a direction orthogonal to an axial direction of the wires. A connector is used to connect the wires included in the wiring member to another circuit. The connector includes a housing and terminals, and the wires are connected to the terminals of the connector.

Japanese Unexamined Patent Publication No. 2010-146939 discloses an assembly where wires arranged as described above are soldered to terminals in a connector. The connector described in Japanese Unexamined Patent Publication No. 2010-146939 includes terminals in the form of thin plates respectively corresponding to the wires and a housing for holding the terminals. The housing has a flat terminal arrangement surface and the terminals are held in such a manner as to be exposed on the terminal arrangement surface. On the other hand, an insulation coating is removed in advance on an end of each of the wires to expose a conductor, and the wires are held at a position near tips of the conductors so that the tips of the conductors are aligned in a row.

In the above connector, cream solder is set in advance on surfaces of the terminals, and the tips of the conductors and the surfaces of the terminals are soldered by pressing the tips of the conductors of the terminals against the surfaces of the terminals by a heater with the tips of the conductors positioned on the cream solder. The cream solder then is heated.

In the electrical connection assembly with the wires and the connector as described above, it is required not only to connect the wires to an external circuit, but also to connect specific wires to form a branch circuit. Such mutual connection is, for example, thought to be (i) mutual connection of specific terminals via dedicated connecting members as described in Japanese Unexamined Patent Publication No. 2010-146939, (ii) replacement of specific terminals by dedicated special terminals for forming the branch circuit or (iii) splice connection of specific wires at a position remote from the connector by a dedicated structure independent of the connector.

However, any of the methods (i) to (iii) requires special component(s) dedicated for mutual connection different from the terminals with a normal specification and a considerable cost increase is inescapable. Further, in terms of manufacturing, the methods (i) and (iii) are accompanied by a considerable increase of man-hours, and the method (ii) is accompanied by the complication of the management of the terminals including the special terminals. Any of these hinders an improvement of production efficiency.

An object of the invention is to provide an electrical connection assembly including wires and a connector and enabling conductors of desired wires to be connected by a simple structure without being accompanied by a considerable cost increase, and a method capable of efficiently manufacturing the electrical connection assembly.

SUMMARY

To achieve the above object, the inventor focused on connecting members for connecting the wires and the terminals corresponding to these wires. The connecting member is formed from solder and therefore has a high degree of shape freedom. Thus, by devising the shape, the conductors of the specific wires can be connected without adding a special member.

The invention was developed from such a perspective. An electrical connection assembly provided by the invention is provided with wires each of which has a conductor. The electrical connection assembly also has terminals respectively corresponding to the wires. Connecting members made of solder are to be applied respectively to the terminals, and an insulating housing collectively holds the terminals arranged in a wire arrangement direction orthogonal to a longitudinal direction of the wires such that the wires are conductively connectable to the terminals respectively via the connecting members while being arranged at intervals in the wire arrangement direction. Each of the terminals includes a wire connection surface connectable to the conductor of each of the wires, and the connecting member is fixed on the wire connection surface. The wires include a first wire and a second wire to be connected electrically. The terminals include a first terminal and a second terminal respectively corresponding to the first wire and the second wire, and the connecting members include a first connecting member to be applied to the first terminal and a second connecting member to be applied to the second terminal. The first connecting member includes a bulging portion bulging in a direction toward the second wire from the wire connection surface of the first terminal and to be connected electrically to the conductor of the second wire.

As described above, according to the present invention, an electrical connection assembly has wires and a connector and enables conductors of desired wires to be connected by a simple structure without being accompanied by a considerable cost increase and a method for efficiently manufacturing the electrical connection assembly are provided.

According to this electrical connection assembly, by shaping a connecting member serving as a connecting medium for connecting a first wire and a first terminal into a shape bulging toward a second wire from a wire connection surface of the first terminal, the connecting member also can be utilized as a connecting medium for connecting the first wire and the second wire, so that connection of the first and second wires can be achieved by a simple structure requiring no special member.

A bulging portion of a first connecting member may be fixed directly to a conductor of the second wire. According to this structure, direct fixing of the first connecting member to the conductors of the first and second wires, i.e. connection of the first and second wires only via the first connecting member, ensures high connection reliability.

If the first and second terminals are held in the insulating housing at positions such that the wire connection surface of the first terminal and the wire connection surface of the second terminal are displaced from each other in a longitudinal direction of the first and second wires, the bulging portion of the connecting member applied to the first terminal may bulge in a direction parallel to the wire arrangement direction from the wire connection surface of the first terminal and is fixed directly to the conductor of the second wire. In this way, a bulging length of the bulging portion for connection of the first and second wires can be suppressed to be small while the first and second terminals are spaced apart sufficiently by mutual displacements of the first and second terminals in the longitudinal direction.

In addition to the bulging portion of the first connecting member, the second connecting member may include a bulging portion bulging in a direction toward the first wire from the wire connection surface of the second terminal and the bulging portion of the second connecting member may be fixed directly to the conductor of the first wire. By such double connection, the reliability of connection of the first and second wires is further enhanced.

Alternatively, the bulging portion of the first connecting member may bulge in toward the second terminal from the wire connection surface of the first terminal and be fixed to the second terminal or the second connecting member. Also in this case, the first and second wires can be connected via the first connecting member and also the second connecting member. In the latter case, the first and second connecting members can be integrated to constitute a singley connecting member, for example, by being melted and subsequently solidified. This dramatically improves connection reliability as compared to a mode in which the first and second connecting members are merely in contact.

Further, a method is provided for manufacturing an electrical connection assembly with a connector and wires each of which includes a conductor. The wires include a first wire and a second wire that are connected to one another. The method includes a connector preparing step of preparing a connector including terminals respectively corresponding to the wires and including a first terminal corresponding to the first wire and a second terminal corresponding to the second wire, connecting members made of solder to be applied respectively to the of terminals and including a first connecting member to be applied to the first terminal and a second connecting member to be applied to the second terminal, and an insulating housing for collectively holding the terminals arranged in a wire arrangement direction orthogonal to a longitudinal direction of the wires such that the wires are conductively connectable to the terminals respectively via the connecting members while being arranged at intervals in the wire arrangement direction. The first connecting member includes a bulging portion bulging toward the second wire from the wire connection surface of the first terminal. The method also includes a terminal connecting step of electrically connecting parts of the conductors of the wires and the wire connection surfaces corresponding thereto via the connecting members by heating and melting the connecting members while respectively bringing the wires into contact with the connecting members with the wires arranged at intervals from each other in the wire arrangement direction. The method further includes a conductor connecting step of mutually connecting the conductor of the first wire and the conductor of the second wire via the first connecting member by heating and melting the bulging portion of the first connecting member.

According to this method, connection of the wires and the terminals corresponding to these wires via the connecting members (terminal connection) and connection of the conductor of the first wire and the conductor of the second wire via the first connecting member can be performed efficiently by a simple operation of heating and melting each of the connecting members.

Particularly, for the first connecting member, the terminal connecting step of connecting the first wire and the first terminal via the first connecting member and the mutually connecting step can be performed simultaneously by heating the first connecting member. Thus, production efficiency of the electrical connection assembly can be improved as compared to the case where the terminal connecting step and the conductor connecting step are performed individually.

The connector preparing step may include forming the bulging portion on the first connecting member by plastically deforming the first connecting member with the first connecting member fixed to the wire connection surface of the first terminal. In this method, the bulging portion can be formed easily by plastically deforming the connecting member, utilizing a property of the solder constituting the connecting member.

The bulging portion may be formed after the terminals are held in the insulating housing. This enables the bulging portion to be positioned more reliably with respect to the first wire The connector in which the bulging portion of the first connecting member is shaped to be able to directly contact the conductor of the second wire is prepared in the connector preparing step, and the bulging portion is heated and directly fixed to the conductor of the second wire while being directly in contact with the second wire in the conductor connecting step. According to this method, it is possible to fix the first connecting member directly to the conductor of the second wire, i.e. directly connect the first and second wires via the first connecting member by a simple operation of heating only the bulging portion with the bulging portion and the second wire held in contact. Thus, high reliability for the mutual connection can be obtained.

The connector in which the first and second terminals are held in the insulating housing at such positions that the wire connection surface of the first terminal and the wire connection surface of the second terminal are displaced from each other in the longitudinal direction of the first and second wires and the bulging portion of the connecting member to be applied to the first terminal bulges in a direction parallel to the wire arrangement direction from the wire connection surface of the first terminal is prepared in the connector preparing step, and if the bulging portion is fixed to the conductor of the second wire at a position deviating in the longitudinal direction from the wire connection surface of the second terminal in the mutually connecting step, a bulging length of the bulging portion for mutual connection of the first and second wires can be suppressed to be small while the first terminal and the second terminal are sufficiently spaced apart by mutual displacements of the first and second terminals in the longitudinal direction.

Further, the connector in which the second connecting member includes a bulging portion bulging in toward the first wire from the wire connection surface of the second terminal in addition to the bulging portion of the first connecting member may be prepared in the connector preparing step, and the bulging portion of the second connecting member may be fixed directly to the conductor of the first wire in the conductor connecting step. The reliability of mutual connection of the first and second wires is enhanced by such double connection.

The connector in which the bulging portion of the first connecting member bulges in toward the second terminal from the wire connection surface of the first terminal may be prepared in the connector preparing step, and the bulging portion may be fixed to the second terminal or the second connecting member by being heated and melted in the conductor connecting step. Also in this method, the first and second wires can be connected via the first connecting member and also the second connecting member by a simple operation of heating only the bulging portion.

Particularly in the latter case, the first connecting member and the second connecting member can be integrated to form a single connecting member by heating and melting both the first connecting member and the second connecting member. In this way, the first and second wires can be connected with higher connection reliability than in a mode in which the first and second connecting members are merely in contact.

Further, in addition to forming the first connecting member with the bulging portion bulging toward the second connecting member from the wire connection surface of the first terminal, it is also possible to form the second connecting member with a bulging portion bulging toward the first connecting member from the wire connection surface of the second terminal and integrate the bulging portions with each other to form the mutually connecting member by heating the bulging portions of the first and second connecting members. According to this method, even if the first and second terminals are at a distance from each other, the conductor of the first wire and the conductor of the second wire can be connected with high reliability while the bulging lengths of the respective bulging portions of the first and second connecting members are suppressed to be small.

DETAILED DESCRIPTION

Figure 1:
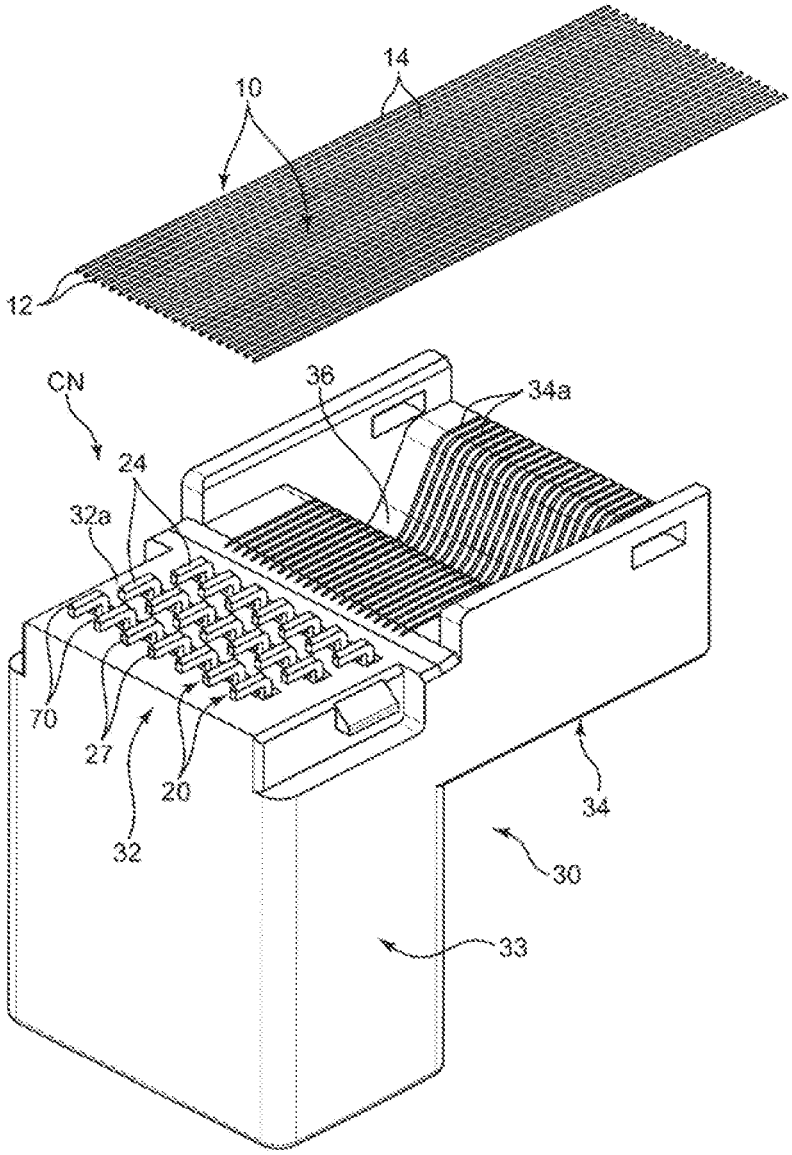
FIG. 1 is an exploded perspective view of an electrical connection assembly according to a first embodiment of the present invention.
Figure 2:
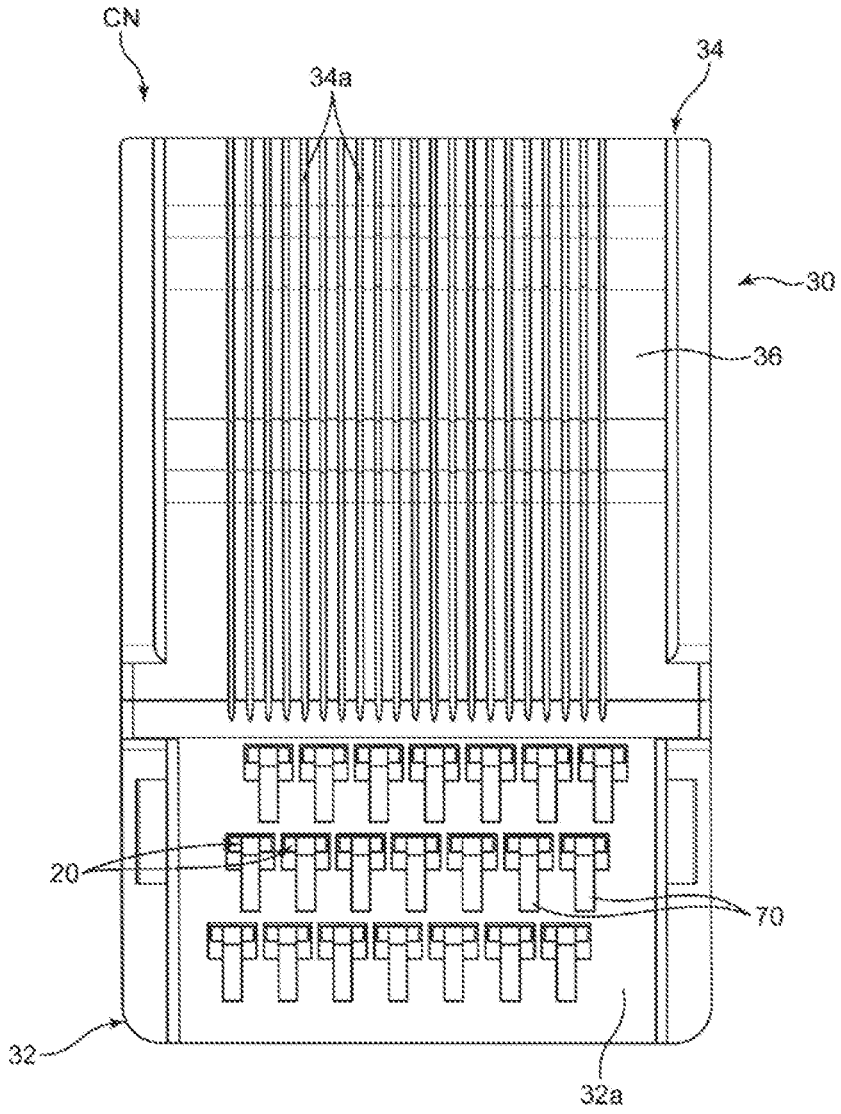
FIG. 2 is a plan view of a connector constituting the electrical connection assembly.
Figure 3:
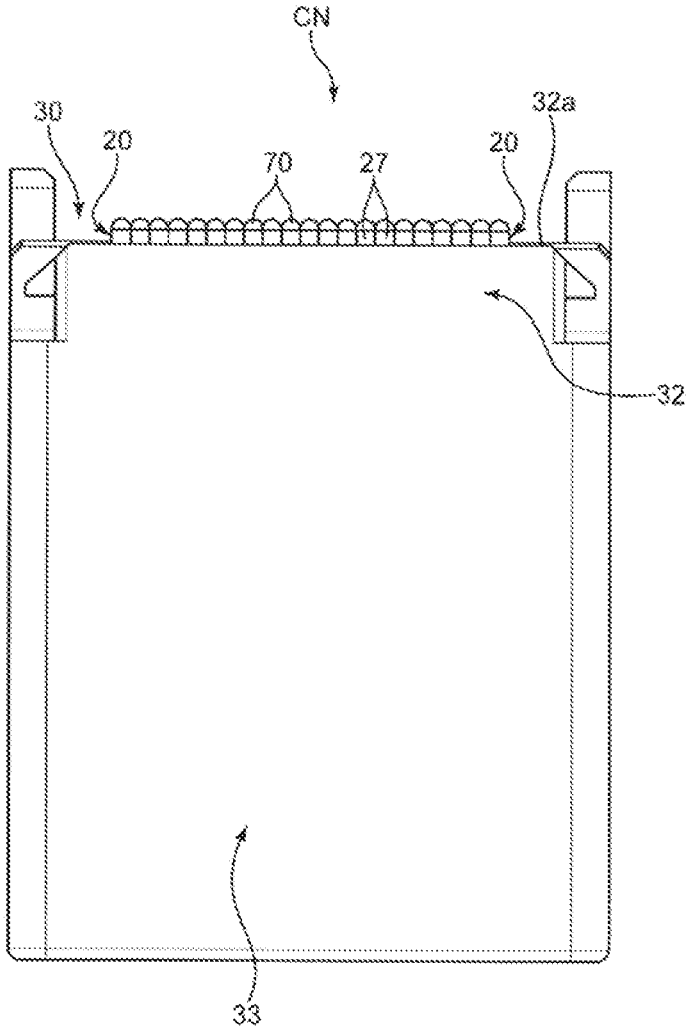
FIG. 3 is a front view of the connector.

FIGS. 1 to 16 show an electrical connection assembly and a manufacturing method therefor according to a first embodiment of the invention. The electrical connection assembly includes wires 10 and a connector CN for connecting the plurality of wires 10 to another connector. FIGS. 1 to 3 show the connector CN before the wires 10 are connected.

Figure 10:
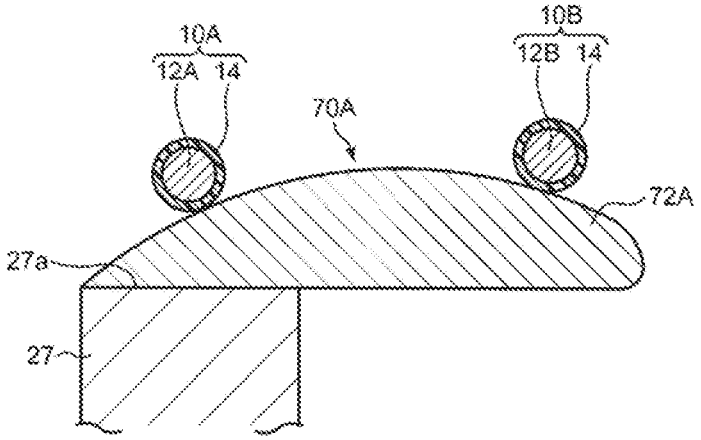
FIG. 10 is a front view in section showing the state of FIG. 9.
Figure 13:
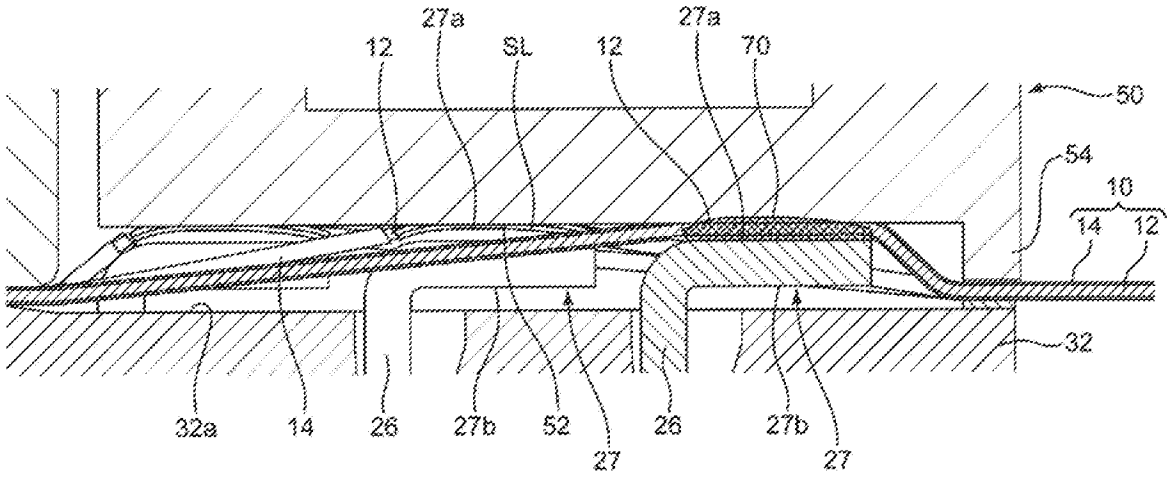
FIG. 13 is an enlarged view of an area enclosed by a frame line XIII in FIG. 12.

Each of the wires 10 includes a conductor 12 and an insulation coating 14 covering the conductor 12, as shown in FIGS. 10 and 13. The wires 10 are connected to the connector CN while being arranged in parallel to each other at intervals in a wire arrangement direction orthogonal to a longitudinal direction of the wires 10. The wires used in the present invention may be bare wires without the insulation coatings 14.

Figure 9:
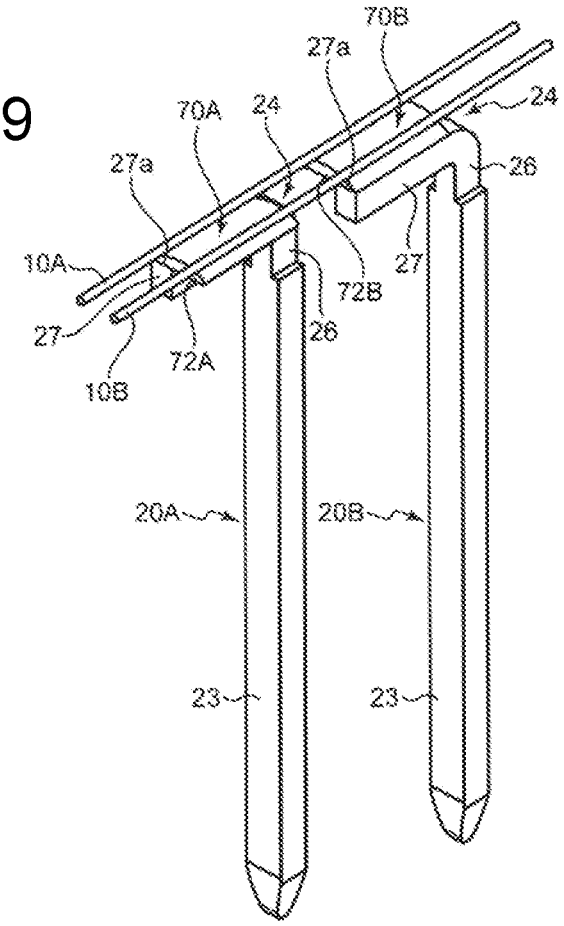
FIG. 9 is a perspective view showing a state where a first wire and a second wire are placed on the first and second connecting members.

The wires 10 include a first wire 10A and a second wire 10B, as shown in FIGS. 9 and 10. These first and second wires 10A, 10B are adjacent in the wire arrangement direction and are to be connected electrically to each other to constitute a branch circuit. A structure and a method for connecting the first and second wires 10A, 10B are described in detail later.

The connector CN includes terminals 20 respectively corresponding to the wires 10, an insulating housing 30 for collectively holding the terminals 20 and connecting members 70 made of solder and applied to the terminals 20.

Figure 4:
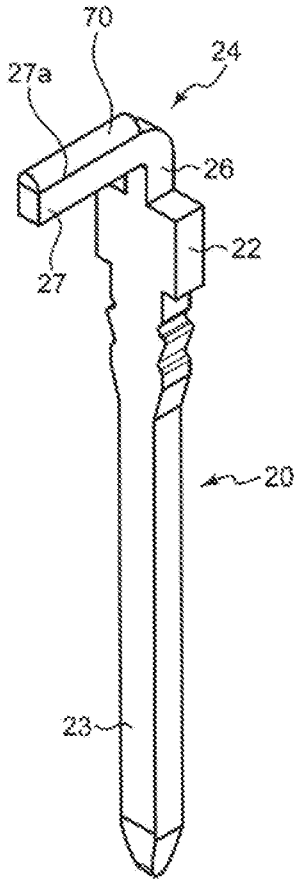
FIG. 4 is a perspective view showing a first terminal and a second terminal constituting the connector and a first connecting member and a second connecting member fixed to wire connection surfaces of the first and second terminals.

Each of the terminals 20 according to this embodiment is a male terminal constituted by a single long metal plate and includes a held portion 22, an electrical contact portion 23 and an outward projection 24, as shown in FIG. 4. The held portion 22 is to be held in the insulating housing 30, as described later. The electrical contact portion 23 is a male contact portion in this first embodiment and is shaped to fit to a female contact portion of a mating terminal. Specifically, the electrical contact portion 23 extends straight in a first direction to be described later from the held portion 22. The outward projection 24 projects from the held portion 22 toward a side opposite to the electrical contact portion 23 and is connected to a corresponding one of the wires 10. The outward projection 24 is described in detail later.

As shown in FIG. 9, the terminals 20 include a first terminal 20A and a second terminal 20B respectively corresponding to the first and second wires 10A, 10B. The first and second terminals 20A, 20B are arranged adjacent to each other in the wire arrangement direction. As shown in FIG. 10, the first wire 10A includes a first conductor 12A and the second wire 10B includes a second conductor 12B.

The insulating housing 30 is molded of an insulating material such as synthetic resin and integrally includes a terminal holding portion 32, a receptacle 33 and a wire holding portion 34.

The terminal holding portion 32 holds the held portion 22 of each of the terminals 20 and has a block shape in this first embodiment. This terminal holding portion 32 collectively holds the terminals 20 to arrange the terminals 20 in the wire arrangement direction so that the wires 10 can be connected conductively to the outward projecting portions 24 of the respective terminals 20 while being arranged at intervals in the wire arrangement direction.

Specifically, the terminal holding portion 32 holds the held portions 22 of the terminals 20 in a state where the respective terminals 20 penetrate through the terminal holding portion 32 in a direction parallel to the first direction. The first direction is orthogonal to both the longitudinal direction of the wires 10 and the wire arrangement direction with the wires 10 connected to the terminals 20, and is an upward direction in an orientation shown in FIG. 12. That is, in the orientation shown in FIG. 12, parts of the terminals 20 including the held portions 22 penetrate through the terminal holding portion 32 in a vertical direction. The held portions 22 may be fixed to the terminal holding portion 32 by being press-fit into through holes in the terminal holding portion 32 or may be fixed using an adhesive or the like.

The electrical contact portion 23 of each terminal 20 extends from the held portion 22 in a direction (down in FIG. 12) opposite to the first direction with the held portion 22 held in the terminal holding portion 32, as described above, and is fit into the female contact portion of the mating terminal in this direction. The receptacle 33 is integral to the terminal holding portion 32 and has a tubular shape to surround the electrical contact portions 23 on an outer side in a direction orthogonal to an axial direction (vertical direction in the orientation shown in FIG. 12) of the electrical contact portions 23.

Figure 5:
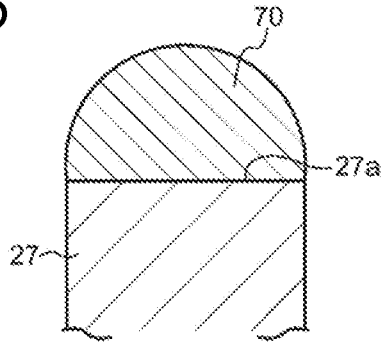
FIG. 5 is a front view in section showing the first connecting member fixed to the wire connection surface of the first terminal.

The outward projection 24 of each terminal 20 integrally includes a first projecting portion 26 and a second projecting portion 27, as shown in FIGS. 4, 5 and 13. The first projecting portion 26 projects in the first direction (up in FIG. 13) from a surface (upper surface 32*a* in FIG. 13) of the terminal holding portion 32. The second projecting portion 27 extends from the upper end of the first projecting portion 26 in a second direction (direction parallel to the upper surface 32*a* in this first embodiment; lateral direction in FIG. 13) closer to a direction parallel to the surface of the terminal holding portion 32 than the first direction and orthogonal to the wire arrangement direction.

The second projecting portion 27 has a wire connecting surface 27*a* (upper surface in FIG. 13) that is opposite to the upper surface 32*a* in FIG. 13) of the terminal holding portion 32. The wire connection surface 27*a* is to be connected electrically to a part of the conductor 12 of the wire 10, by soldering (i.e. using the connecting member 70 as a connecting medium) with the part to be connected placed on the wire connection surface 27*a* via the connecting member 70. The wire connection surface 27*a* according to this first embodiment extends parallel to the upper surface 32*a* of the terminal holding portion 32.

Figure 6:
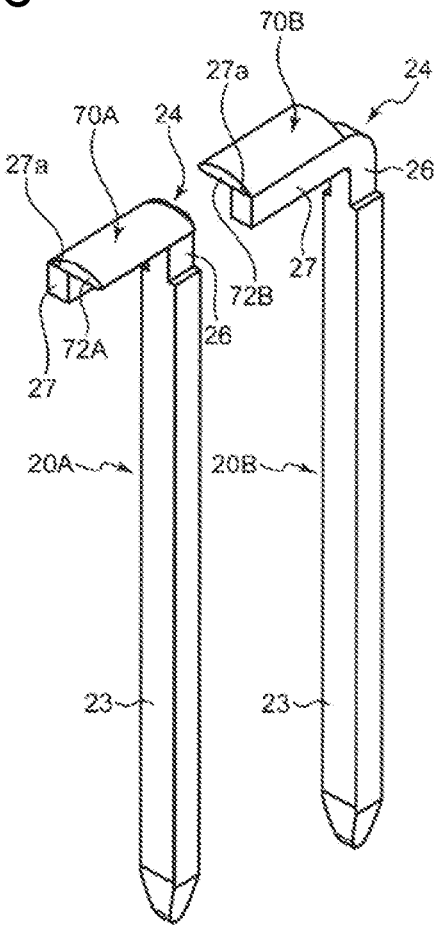
FIG. 6 is a perspective view showing a state where the first and second connecting members are respectively plastically deformed to include a first bulging portion and a second bulging portion.
Figure 7:
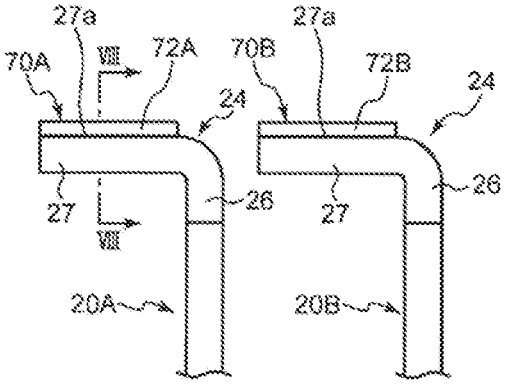
FIG. 7 is a side view showing the state of FIG. 6.

The connecting members 70 are fixed respectively to the wire connection surfaces 27*a* of the respective terminals 20. The connecting member 70 has a cross-sectional shape to bulge up from the wire connection surface 27*a* and is set on the wire connection surface 27*a* to extend along the longitudinal direction of the wire 10. As shown in FIGS. 6 and 7, the connecting members 70 include a first connecting member 70A to be applied to the first terminal 20A and a second connecting member 70B to be applied to the second terminal 20B.

A projecting dimension of the first projecting portion 26 from the upper surface 32*a* of the terminal holding portion 32 is set in this first embodiment to position the second projecting portion 27 to extend in the second direction at a position where a surface of the second projecting portion 27 facing the upper surface 32*a* of the terminal holding portion 32, i.e. an inner side surface (lower surface in FIG. 13) opposite to the wire connection surface 27*a* is separated outward (up in FIG. 13) from the upper surface of the terminal holding portion 32. This projecting dimension is equal for all of the terminals 20. Accordingly, the terminal holding portion 32 holds the terminals 20 such that the wire connection surfaces 27*a* of the respective terminals 20 are arranged on the same plane. Conversely, a specific height difference may be given between the wire connection surfaces 27*a*.

The terminals 20 also can arranged freely. The terminal holding portion 32 according to this first embodiment holds the held portions 22 of the terminals 20 such that the wire connection surfaces 27*a* of the terminals 20 are arranged at intervals in the wire arrangement direction and, in addition, the wire connection surfaces 27*a* of the terminals 20 adjacent in the wire arrangement direction are displaced from each other in the longitudinal direction (vertical direction of FIG. 2) of the wires 10. Specifically, in the arrangement shown in FIG. 2, the outward projections 24 are arranged along three rows in a direction parallel to the longitudinal direction of the wires 10 and the positions of the wire connection surfaces 27*a* of the outward projections 24 in each row are displaced from the positions of the wire connection surfaces 27*a* of the outward projections 24 arranged in the row(s) adjacent to this row in the wire arrangement direction.

Accordingly, the terminal holding portion 32 according to this embodiment holds the first and second terminals 20A, 20B at such positions that the wire connection surface 27*a* of the first terminal 20A and the wire connection surface of the second terminal 20B are displaced in the longitudinal direction of the first and second wires 10A, 10B and the wire arrangement direction as shown in FIGS. 9 and 10.

The wire holding portion 34 extends parallel to the second direction from the terminal holding portion 32 and holds each of the wires 10 in such a posture that the wires 10 extend along the second direction. The wire holding portion 34 according to this first embodiment includes parallel wire holding grooves 34*a* respectively corresponding to the wires 10 and supports the wires 10 from below with the respective wires 10 fit in the wire holding grooves 34*a*.

Figure 8:
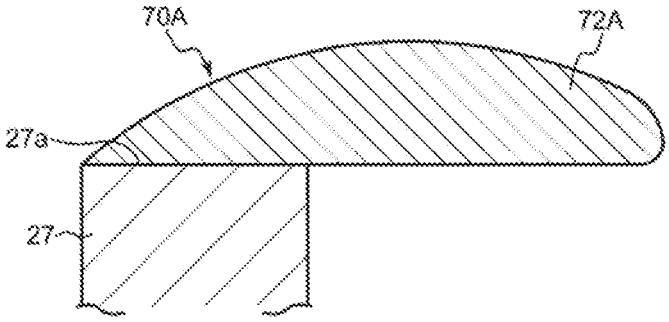
FIG. 8 is a front view showing a cross-section along VIII-VIII of FIG. 7.

The first connecting member 70A is shaped to include a first bulging portion 72A and the second connecting member 70B is shaped to include a second bulging portion 72B, as shown in FIGS. 6 to 8. The first bulging portion 72A bulges toward the second wire 10B (right in FIGS. 6 and 8) along a direction parallel to the wire arrangement direction from the wire connection surface 27*a* of the first terminal 20A, and the second bulging portion 72B bulges toward the first wire 10A (left in FIG. 6) along the direction parallel to the wire arrangement direction from the wire connection surface 27*a* of the second terminal 20B.

A bulging length of the first bulging portion 72A is set such that the second wire 10B can be placed on the first bulging portion 72A, as shown in FIGS. 9 and 10. Similarly, a bulging length of the second bulging portion 72B is set such that the first wire 10A can be placed on the second bulging portion 72B, as shown in FIG. 9. Cross-sectional shapes of the first and second connecting members 70A, 70B can be set freely within such a range as to satisfy these conditions. For example, the first and second connecting members 70A, 70B may have a laterally long rectangular cross-section.

Figure 16:
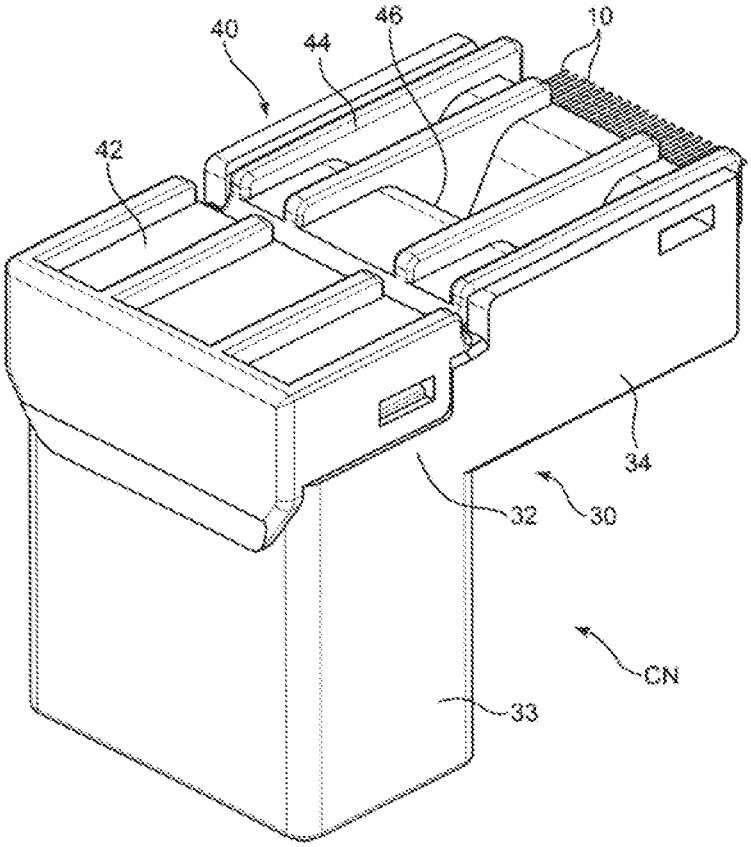
FIG. 16 is a perspective view showing a state where a cover is mounted on an insulating housing of the connector.
Figure 17:
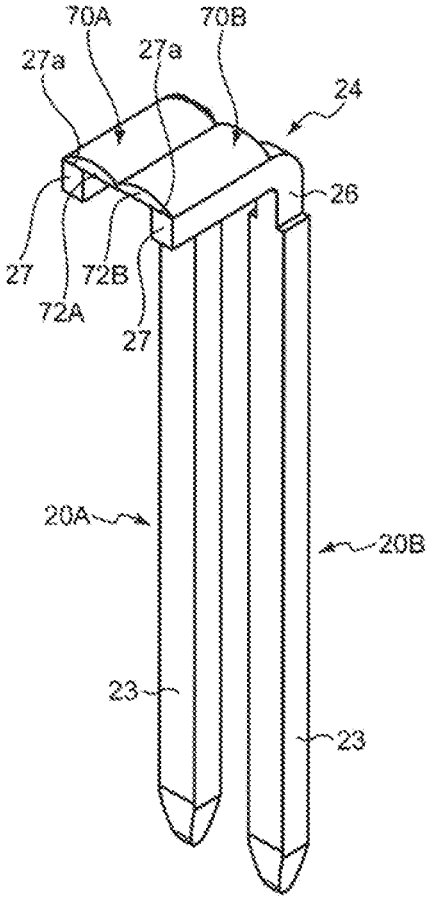
FIG. 17 is a perspective view showing a state where a first connecting member and a second connecting member according to a second embodiment of the present invention are respectively plastically deformed to include a first bulging portion and a second bulging portion.
Figure 18:
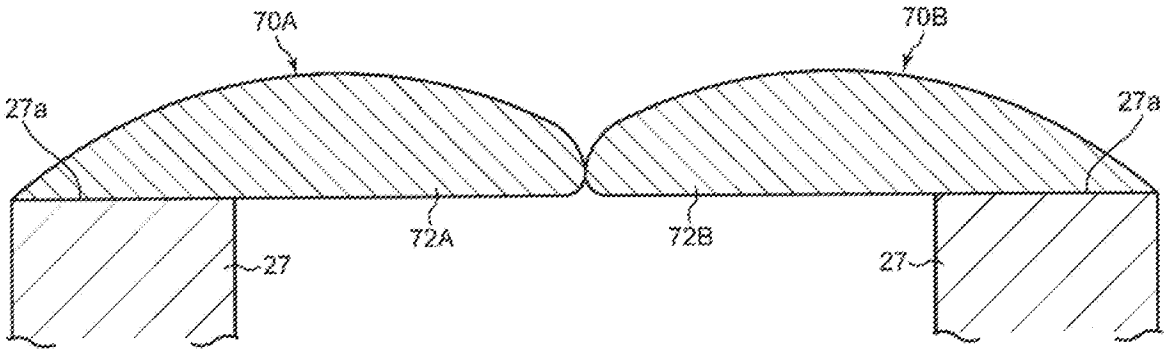
FIG. 18 is a front view in section showing the state of FIG. 17.

The connector CN of this embodiment further includes a cover 40, as shown in FIG. 16. The cover 40 is mounted detachably on the insulating housing 30 to cover the outward projections 24 of the terminals 20 and the wires 10 connected to the outward projections 24 from above. Specifically, the cover 40 of this first embodiment integrally includes a terminal cover portion 42 for covering the terminal holding portion 32 and a wire cover portion 44 for covering the wire holding portion 34.

The wire holding portion 34 includes a curved portion 36 in which the upper surface of the wire holding portion 34, i.e. a surface formed with the wire holding grooves 34*a*, is curved to be recessed down at an intermediate position in the second direction. On the other hand, the lower surface of the wire cover portion 44 of the cover 40 includes a curved portion 46 bulging down to correspond to the curved portion 36. The curved portions 46, 36 are shaped to restrain intermediate parts of the wires 10 with the intermediate parts curved downward, thereby suppressing the action of tensile forces of the wires 10 at connected positions of the conductors 12 of the respective wires 10 and the wire connection surfaces 27*a*.

The wire holding portion 34 and the cover 40 are not essential in the present invention and can be omitted. Conversely, if the parts to be connected of the conductors 12 of the respective wires 10 are not set near the ends of the wires 10, but in longitudinal intermediate parts of the wires 10, the wire holding portions 34 and the wire cover portions 44 of the cover 40 corresponding to the wire holding portions 34 may be provided on both sides of the terminal holding portion 32 in the longitudinal direction of the wires 10.

This electrical connection assembly can be manufactured, for example, by a method including 1) a wire preparing step, 2) a connector preparing step, 3) a terminal connecting step and a mutually connecting step (both steps are performed simultaneously in this embodiment) and 4) a cutting step.

1) Wire Preparing Step

The wires 10 described above are prepared in advance. In this embodiment, the wires 10 including the insulation coatings 14 made of specific synthetic resin are prepared. The specific synthetic resin is meltable or decomposable at a melting temperature (e.g. 380 to 400° C.) of the solder constituting the connecting members 70 while having an insulating property at ordinary temperatures. Polyurethane, polyester, nylon and the like are suitable as the specific synthetic resin. A thickness of the insulation coating 14 is set such that the insulation coating 14 can be removed to expose the conductor 12 by heating while an insulated state is ensured at ordinary temperatures. A dimension approximate to a thickness of an insulation coating in an ordinal enamel wire can be, for example, applied as this thickness.

2) Connector Preparing Step

The steps of preparing the connector CN include 2-1) a connecting member applying step, 2-2) a terminal setting step and 2-3) a bulging portion forming step.

2-1) Connecting Member Applying Step

The connecting member 70 is fixed to the wire connection surface 27*a* of each of the terminals 20 constituting the connector CN. The shape of the connecting member 70 in this stage can be set freely. Generally, the connecting member 70 is fixed to the wire connection surface 27*a* to have such a cross-sectional shape that a central part of the wire connection surface 27*a* in a width direction (direction parallel to the wire arrangement direction) is raised, as shown in FIGS. 4 and 5. The connecting member 70 may be applied to the terminal 20 by fixing the solder of the connecting member 70 and kept in a solid state to the wire connection surface 27*a* or by applying paste solder (connecting member 70) to the wire connection surface 27*a*.

2-2) Terminal Setting Step

This step fixes the terminals 20 in the insulating housing 30, i.e. a step of holding the terminals 20 in the insulating housing 30. Specifically, in this first embodiment, the terminals 20 are fixed at predetermined positions of the terminal holding portion 32 by inserting and press-fitting the terminals 20 into through holes formed in advance in the terminal holding portion 32 of the insulating housing 30 from above (i.e. by causing the held portions 22 to bite into inner peripheral surfaces of the terminal holding portion 32 enclosing the through holes) or by fixing the held portions 22 to the terminal holding portion 32 by another means such as an adhesive.

The terminal setting step may be performed before the connecting member applying step. That is, the connecting members 70 may be applied with the terminals 20 held in the insulating housing 30. However, if the connecting members 70 are applied by being heated (heating at a temperature beyond the melting point of the solder), the insulating housing 30 is required to have heat resistance sufficient to withstand the heating with the respective terminals 20 already held in the insulating housing 30, and the material of the insulating housing 30 is limited by that much. Accordingly, the connecting member applying step preferably is performed before the terminal setting step, i.e. the connecting members 70 are applied to the terminals 20 before the terminals 20 are set in the insulating housing 30.

2-3) Bulging Portion Forming Step

This step plastically deforms the first connecting member 70A and the second connecting member 70B respectively applied to the first and second terminals 20A, 20B and deforms the connecting members 70A and 70B into shapes, as shown in FIGS. 6 to 8, i.e. a step of forming the first bulging portion 72A and the second bulging portion 72B respectively on the first and second connecting members 70A, 70B. The connecting members 70 made of solder, as described above, easily can be deformed plastically by pressing a mold having a suitable shape against the first and second connecting members 70A, 70B. In other words, the shapes of the first and second bulging portions 72A, 72B, i.e. shapes bulging in the direction parallel to the wire arrangement direction from the wire connection surfaces 27*a* of the first and second terminals 20A, 20B, can be set freely set by selecting the shape of the mold.

This bulging portion forming step may be performed before or simultaneously with the terminal setting step and the connecting member applying step. For example, the bulging portions 72A, 72B may be formed before the terminals 20 are held in the insulating housing 30 after the connecting members 70 are applied to the respective terminals 20 or the first and second connecting members 70A, 70B respectively already formed with the first and second bulging portions 72A, 72B may be fixed to the wire connection surfaces 27*a* of the first and second terminals 20A, 20B. However, to perform the bulging portion forming step after the connecting member applying step and the terminal setting step, i.e. to form the bulging portions 72A, 72B with the terminals 20 positioned with respect to the insulating housing 30 and with respect to each other by holding the terminals 20 by the insulating housing 30, enables more reliable positioning of the bulging portions 72A, 72B and the first and second wires 10A, 10B to be connected to the bulging portions 72A, 72B.

The bulging portion forming step is performed only for the connecting members corresponding to the wires to be connected. For example, the electrical connection assembly provided by the present invention may include wire pairs to be connected (pairs of wires to be mutually connected). In this case, the bulging portion forming step is performed for the connecting members respectively corresponding to the wires to be connected.

3) Terminal Connecting Step and Mutually Connecting Step

The terminal connecting step electrically connects the the conductors 12 of the wires 10 and the wire connection surfaces 27*a* corresponding to these parts to be connected via the connecting members 70 by heating and melting the connecting members 70 while respectively bringing the wires 10 into contact with the connecting members 70 with the wires 10 arranged at intervals from each other in the wire arrangement direction. The mutually connecting step connects the conductor 12A of the first wire 10A and the conductor 12B of the second wire 10B via the first and second connecting members 70A, 70B by heating and melting the first and second bulging portions 72A, 72B of the first and second connecting members 70A, 70B.

In this first embodiment, the terminal connecting step and the mutually connecting step are performed at once. Specifically, the connecting steps are performed by successively performing 3-1) a wire setting operation and 3-2) a heating operation described below.

3-1) Wire Setting Operation

This operation brings parts to be connected set in longitudinally intermediate areas of the wires 10 into contact with the surfaces of the connecting members 70 with the parts to be connected covered by the insulation coatings 14 while holding the wires 10 arranged at intervals from each other in the wire arrangement direction, as shown in FIG. 1.

The wires 10 are held at both outer positions across the parts to be connected, more preferably at positions outward of both ends of the connector CN in a front-rear direction (direction parallel to the second direction and the wire longitudinal direction). The wires 10 are held by being fit into the respective bulging portions 72A, 72B while a suitable tension is applied to each of the wires 10. The wires 10 can be held, for example, using a bobbin on which the plurality of wires 10 are to be wound, a clamping tool for clamping the wires 10 from both sides in a direction orthogonal to the longitudinal direction of the wires 10 and the wire arrangement direction.

In this first embodiment, the first connecting member 70A includes the first bulging portion 72A, i.e. a part bulging in the direction parallel to the wire arrangement direction from the wire connection surface 27*a* corresponding to the first connecting member 70A toward the second wire 10B, and the second connecting member 70B includes the second bulging portion 72B, i.e. a part bulging in the direction parallel to the wire arrangement direction from the wire connection surface 27*a* corresponding to the second connecting member 70B toward the first wire 10A. This enables, as shown in FIGS. 9 and 10, the second wire 10B to contact the second connecting member 70B corresponding thereto, also the first bulging portion 72A of the first connecting member 70A at a position displaced from the second connecting member 70B in the longitudinal direction of the first and second wires 10A, 10B and similarly enables the first wire 10A to contact the first connecting member 70A corresponding thereto, but also the second bulging portion 72B of the second connecting member 70B at a position displaced from the first connecting member 70A in the longitudinal direction.

3-2) Heating Operation

This operation is an operation of electrically connecting the parts to be connected and the wire connection surfaces 27*a* of the terminals 20 corresponding thereto via the connecting members 70 by heating and melting the solder constituting the connecting members 70 with the respective wires 10 set on the corresponding connecting members 70. In this embodiment, a part of the insulation coating 14 of each wire 10 covering the part to be connected of the conductor 12 is heated together with the connecting member 70. Thus, the removal of the insulation coating 14 covering the part to be connected from the surface of the conductor 12 by melting or decomposition and the electrical connection of the conductor 12 exposed by removing the insulation coating 14 and the wire connection surface 27*a* having the connecting member 70 fixed thereto (via the connecting member 70) are achieved simultaneously. In this way, the terminal connecting step for each terminal 20 is performed.

Figure 11:
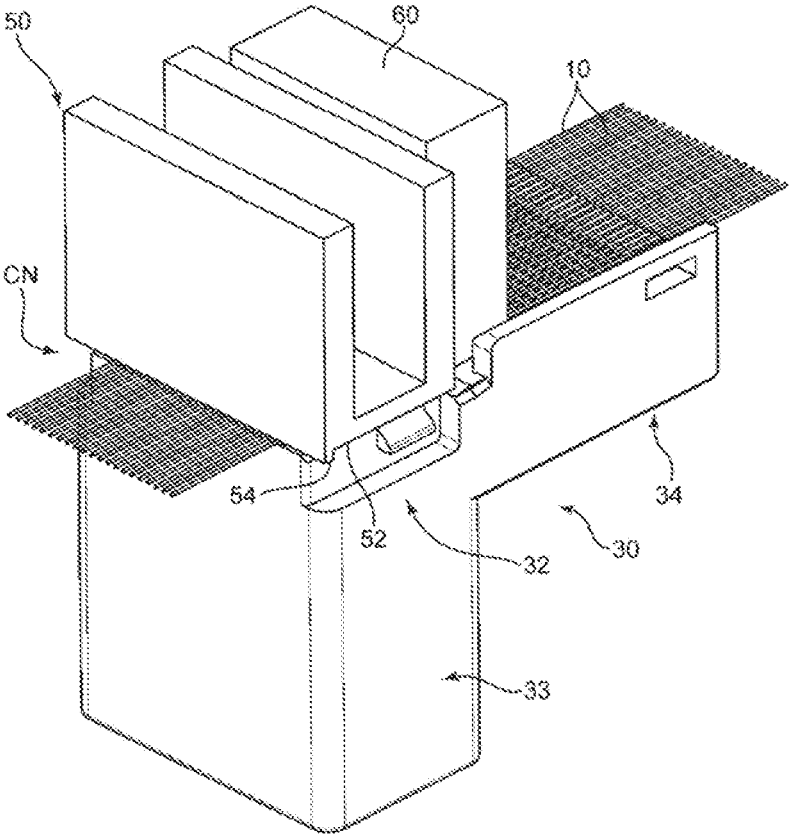
FIG. 11 is a perspective view showing a step of connecting the wire connection surfaces of the respective terminals of the connector and parts to be connected of wires in a method for manufacturing the electrical connection assembly.
Figure 12:
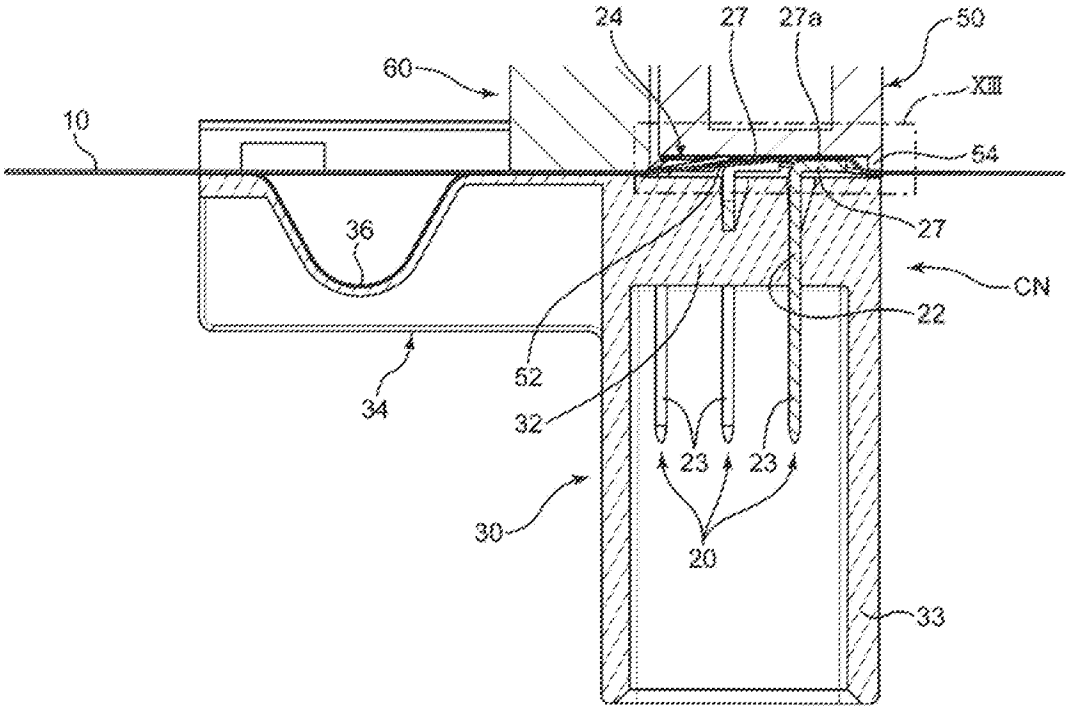
FIG. 12 is a side view in section showing the step shown in FIG. 11.

The wires 10 can be pressed efficiently against the wire connection surfaces 27*a* and heated using a heater 50 shown in FIGS. 11 to 13. This heater 50 has a flat lower heating surface 52. The melting of the connecting members 70 by heating by the heater 52 and the melting or decomposition of the insulation coatings 14 by heating the insulation coatings 14 covering the parts to be connected are performed simultaneously by pressing the heating surface 52 against the wires 10 set on the wire connection surfaces 27*a* via the connecting members 70 from above, i.e. by pressing the heating surface 52 toward the wire connection surfaces 27*a* with the parts to be connected and the connecting members 70 respectively corresponding to the wire connection surfaces 27*a* sandwiched between the heating surface 52 and the respective wire connection surfaces 27*a*. The melting or decomposition of the insulation coatings 14 enables the insulation coatings 14 to be removed from the surfaces of the conductors 12.

In this embodiment, the terminal holding portion 32 of the insulating housing 30 holds the terminals 20 such that the respective wire connection surfaces 27*a* are arranged on the same plane, i.e. the respective terminals 20 constitute the planar array of terminals. Thus, the wire connection surfaces 27*a* and the parts of the conductors 12 of the respective wires 10 to be connected can be connected satisfactorily and simultaneously connected by simultaneously and equally heating the connecting members 70 using the single flat heating surface 52.

Further, since each wire connection surface 27*a* is provided on the outer projection 24 projecting out (up in FIG. 13) from the upper surface 32*a* of the terminal holding portion 32 in this embodiment, the connecting step can be performed with the wire 10 deformed into a convex outward shape at the outward projection 24, as shown in FIG. 13, by pressing the wire 10 against the surface of the insulating housing 30 (preferably the upper surface 32*a* of the terminal holding portion 32) at opposite positions across the outward projection 24 of the terminal 20. Specifically, in an example shown in FIGS. 11 to 13, the connecting step is performed by the cooperation of a pressing portion 54 provided on the heater 50 in advance and projecting farther out than the heating surface 52 and a pressing member 60 prepared separately from the heater 50.

Figure 14:
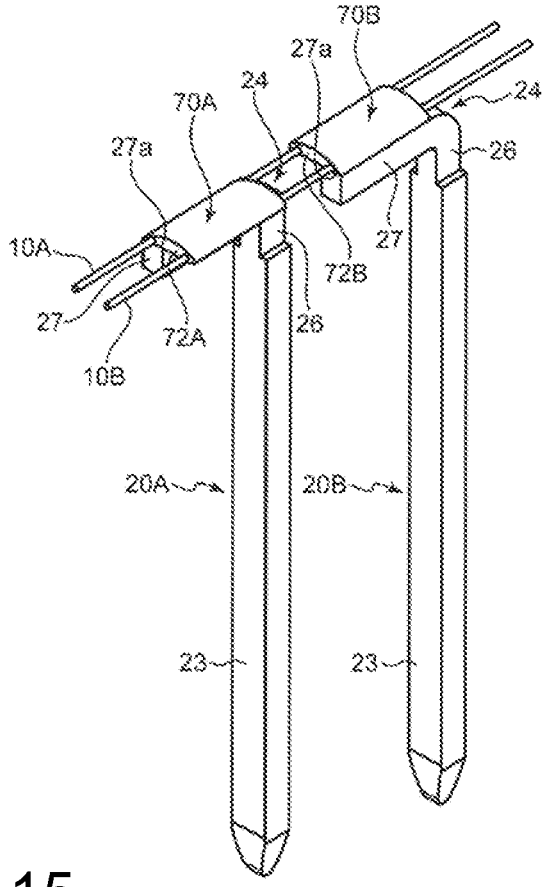
FIG. 14 is a perspective view showing a state where conductors of the first and second wires are mutually connected via the first and second connecting members by melting and subsequently solidifying the first and second connecting members.
Figure 15:
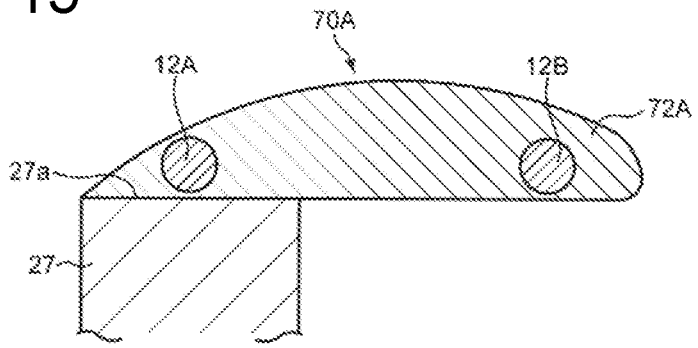
FIG. 15 is a front view in section showing the state of FIG. 14.

Further, in this first embodiment, the insulation coating 14 also is removed in a part of the second wire 10B in contact with the first bulging portion 72A of the first connecting member 70A and the conductor 12B of the second wire 10B is held in direct contact with the first bulging portion 72A, as shown in FIGS. 14 and 15, as the first connecting member 70A is heated by the heater 50. Similarly, the insulation coating 14 also is removed in a part of the first wire 10A in contact with the second bulging portion 72B of the second connecting member 70B and the conductor 12A of the first wire 10A is held in direct contact with the second bulging portion 72B as the second connecting member 70B is heated by the heater 50.

That is, the first connecting member 70A is fixed to the conductor 12A of the first wire 10A corresponding thereto and also is fixed to the conductor 12B of the second wire 10B in the first bulging portion 72A at the position deviating in the wire longitudinal direction from the wire connection surface 27*a* of the first terminal 20A. Similarly, the second connecting member 70B is fixed to the conductor 12B of the second wire 10B corresponding thereto and also is fixed to the conductor 12A of the first wire 10A in the second bulging portion 72B at the position deviating in the wire longitudinal direction from the wire connection surface 27*a* of the second terminal 20B. In this way, the mutually connecting step of mutually connecting the first and second wires 10A, 10B is performed directly utilizing the first and second connecting members 70A, 70B as connecting media without adding any special member.

4) Cutting Step

After the connecting steps are completed as described above, the wires 10 are cut in suitable longitudinal parts. This cutting can be performed efficiently, for example, by sandwiching and shearing the wires 10 at a suitable cutting position in a direction orthogonal to the longitudinal direction of the wires 10 and the wire arrangement direction by two cutting tools. The connector CN according to this first embodiment is connected to the ends of the wires 10 and, hence, the wires 10 are cut at a position opposite to the wire holding portion 34 across the terminal holding portion 32 (preferably at a position in the immediate vicinity of the outer side surface of the terminal holding portion 32).

After this cutting step, the cover 40 as shown in FIG. 16 is mounted if necessary to complete the electrical connection assembly. Note that the cutting step and the mounting of the cover 40 are not essential in the present invention and can be omitted as appropriate.

In this first embodiment, the first connecting member 70A is formed with the first bulging portion 72A and fixed to the second wire 10B and, in addition, the second connecting member 70B is formed with the second bulging portion 72B and fixed to the first wire 10A, but the first and second wires 10A, 10B can be connected only by connecting the first bulging portion 72A and the second wire 10B. However, double connection via the first and second bulging portions 72A, 72B drastically improves the reliability of the connection.

Further, the first bulging portion 72A can be fixed to a conductor of a third wire adjacent to the second wire 10B by being shaped to extend farther in the wire arrangement direction than the above shape. This enables three or more wires to be connected via the first connecting member 70A. Specifically, the present invention widely encompasses the mutual connection of at least the first and second wires using the first connecting member.

Next, a second embodiment of the invention is described with reference to FIGS. 17 to 23.

In this second embodiment, a connector CN similar to the connector CN shown in FIGS. 1 to 3 and wires 10 are used, and a connector preparing step, a terminal connecting step and a mutually connecting step are successively performed. Further, as in the first embodiment, first and second connecting members 70A, 70B are formed with first and second bulging portions 72A, 72B bulging toward mating wires (second wire 10B and first wire 10A) from respective wire connection surfaces 27*a*.

Figure 19:
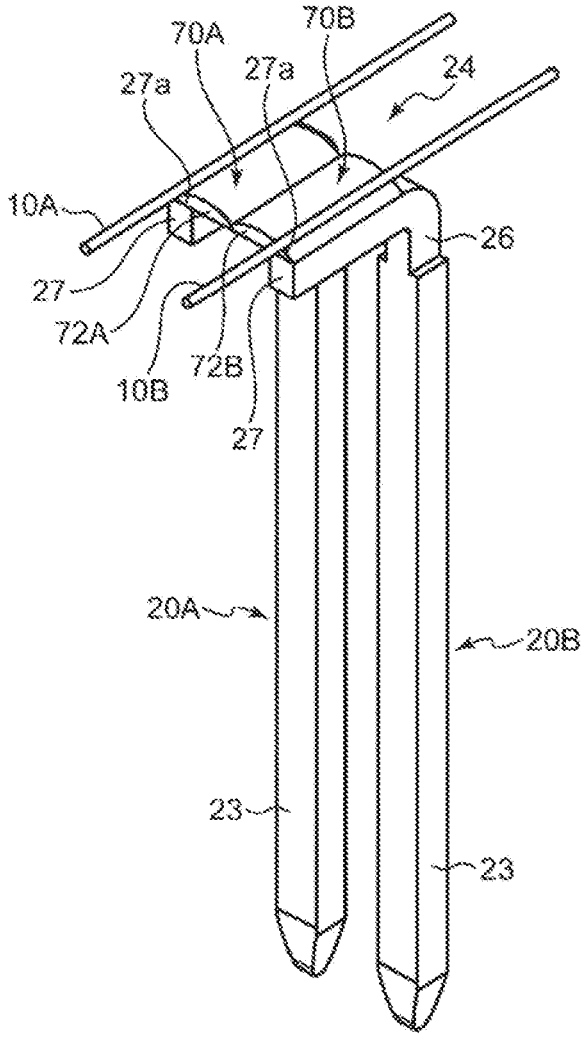
FIG. 19 is a perspective view showing a state where a first wire and a second wire are respectively placed on the first and second connecting members.
Figure 20:
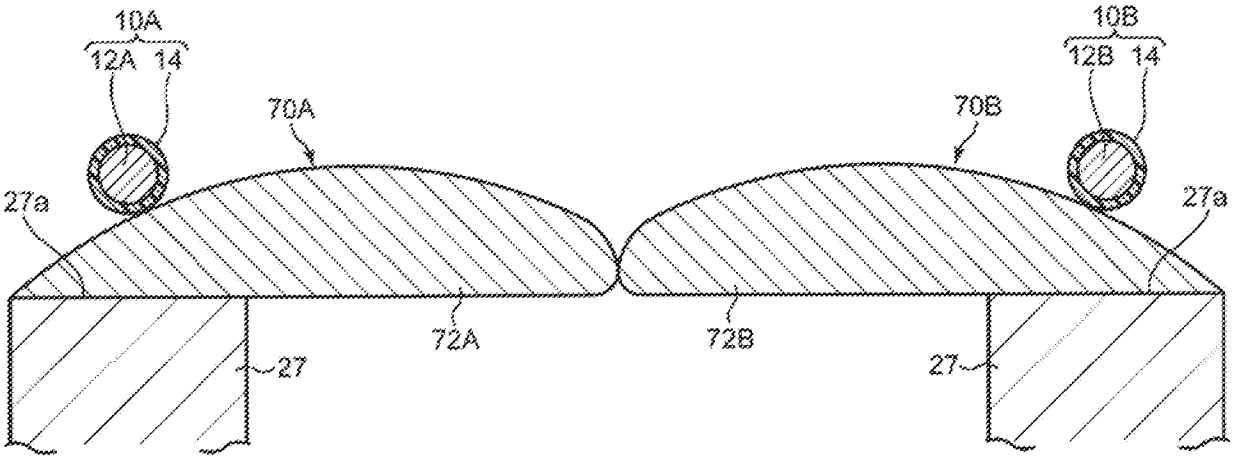
FIG. 20 is a front view in section showing the state of FIG. 19.
Figure 21:
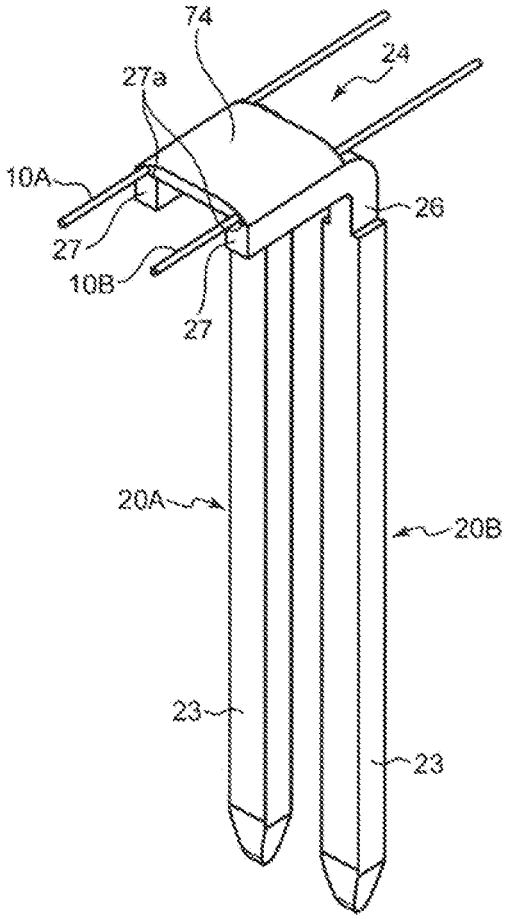
FIG. 21 is a perspective view showing a state where the conductors of the first and second wires are mutually connected via the first and second connecting members by melting and subsequently solidifying the first and second connecting members.
Figure 22:
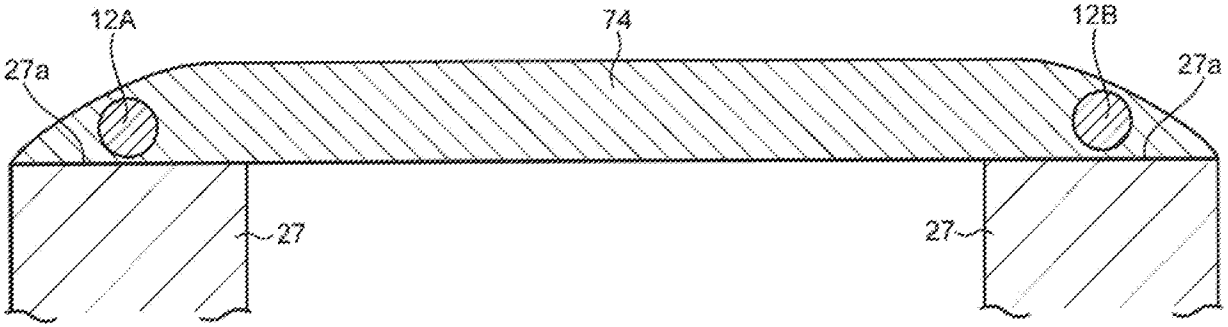
FIG. 22 is a front view in section showing the state of FIG. 21.

However, this second embodiment differs from the first embodiment in the following point. The wire connection surfaces 27*a* of the first and second terminals 20A, 20B adjacent in the wire arrangement direction are displaced in the wire longitudinal direction in the connector CN prepared in the first embodiment, and the first and second bulging portions 72A, 72B formed on the first and second connecting members 70A, 70B are fixed directly to the conductors 12B, 12A of the second and first wires 10B, 10A in the connecting step. In contrast, first and second terminals 20A, 27B are arranged in a direction parallel to the wire arrangement direction in the connector CN prepared in the second embodiment, and the first and second wires 10A, 10B are set on the first and second connecting members 70A, 70B such that only the first wire 10A is in contact with the first connecting member 70A and only the second wire 10B is in contact with the second connecting member 70B as shown in FIGS. 19 and 20 in the terminal connecting step and the connecting step. By heating and meting the first and second connecting members 70A, 70B in this state, the first and second connecting members 70A, 70B are integrated to constitute a single connecting member 74, as shown in FIGS. 21 and 22, and conductors 12A, 12B of the first and second wires 10A, 10B are connected electrically to each other via the connecting member 74.

In this second embodiment, mutual connection is possible only by the contact of the first and second bulging portions 72A, 72B without the first and second connecting members 70A, 70B being integrated. However, the formation of the connecting member 74 by the above integration dramatically improves the reliability of the connection.

A specific mode for achieving integration is not limited to the one shown in FIGS. 17 to 23. For example, tips of the first and second bulging portions 72A, 72B may to overlap in a thickness direction (vertical direction in an orientation according to the first and second embodiments). Alternatively, only the first bulging portion 72A may be formed and a bulging length sufficient to enable the first bulging portion 72A to contact the second connecting member 70B may be given to the first bulging portion 72A. Further, a fixing partner of the first bulging portion 72A is not limited to the second connecting member 70B and may be a suitable part (e.g. side surface of a second projecting portion 27) of the second terminal 20B.

Besides the above, the invention includes the following modes.

A) Concerning Shape of Bulging Portions

The shape of the bulging portion formed at least on the first connecting member is not limited to those shown in the first and second embodiments. For example, the bulging portion may be shaped to stabilize relative positions of the bulging portion and the wire contacted thereby, e.g. shaped to include a groove into which the wire can fit.

Further, a bulging direction of the bulging portion from the wire connection surface is not necessarily limited to the direction parallel to the wire arrangement direction. For example, when the position of the wire connection surface 27*a* of the first terminal 20A and that of the wire connection surface 27*a* of the second terminal 20B are displaced in the wire longitudinal direction, as in the first embodiment, the first bulging portion 72A may extend oblique to the wire arrangement direction to contact the second connecting member 70B or the second terminal 20B despite such a displacement. Conversely, when the positions of the wire connection surfaces 27*a* of the first and second terminals 20A and 20B are aligned in the wire longitudinal direction, as in the second embodiment, the first bulging portion 72A may extend oblique to the wire arrangement direction to be fixable to the conductor 12B of the second wire 10B at a position deviating in the wire longitudinal direction from the second connecting member 70B and the second terminal 20B despite such an alignment.

The above applies also to the shape of the second bulging portion 72B when the second connecting member 70B is formed with the second bulging portion 72B. Concerning Timings of Terminal Connecting Step and Mutually Connecting Step The terminal connecting step and the mutually connecting step may be performed individually instead of being performed simultaneously. For example, the first bulging portion 72A and the conductor 12B of the second wire 10B may be connected by locally heating the first bulging portion 72A of the first connecting member 70A after the conductor 12A of the first wire 10A and the wire connection surface 27*a* are connected via the first connecting member 70A by locally heating a part of the first connecting member 70A according to the first embodiment located right above the wire connection surface 27*a* of the first terminal 20A.

Further, the terminal connecting step may be performed individually for each terminal 20. That is, the connecting members 70 may be heated individually. Alternatively, the connecting members 70 may be heated for each group divided in advance when a multitude of connecting members 70 are present.

Concerning Connection of Wire Connection Surface and Part to be Connected

Although the insulation coating 14 is removed from the surface of the conductor 12 by melting or decomposition simultaneously with the melting of the connecting member 70 by heating by the heater in the first and second embodiments, the insulation coating 14 may be removed before heating. Specifically, the insulation coating may be removed in advance before the connecting step by a stripping process to expose the part to be connected of the conductor set in each of the wires, and the conductor exposed as described above and the wire connection surface may be soldered directly in the connecting step. In this case, a material constituting the insulation coating may not necessarily be meltable or decomposable. It goes without saying that the removal of the insulation coatings is not necessary if the respective wires are bare wires.

D) Concerning Number of Wires

The number of the wires of the electrical connection assembly is not limited. The invention can be applied for electrical connection assemblies with a plurality of wires including at least a first wire and a second wire to be connected.

The invention claimed is:

1. An electrical connection assembly, comprising:

wires each including a conductor;

terminals respectively corresponding to the wires;

connecting members made of solder and respectively applied to the terminals; and an insulating housing collectively holding the terminals arranged in a wire arrangement direction orthogonal to a longitudinal direction of the wires such that the wires are conductively connectable to the terminals respectively via the connecting members while being arranged at intervals in the wire arrangement direction;

wherein:

each of the terminals includes a wire connection surface connectable respectively to the conductors of each of the wires, the connecting members being fixed respectively on the wire connection surfaces;

the wires include a first wire and a second wire to be electrically connected to one another;

the terminals include a first terminal and a second terminal respectively corresponding to the first wire and the second wire;

the connecting members include a first connecting member to be applied to the first terminal and a second connecting member to be applied to the second terminal;

the first connecting member includes a bulging portion bulging toward the second wire from the wire connection surface of the first terminal and to be electrically connected to the conductor of the second wire; and the bulging portion of the first connecting member is fixed directly to the conductor of the second wire.

2. The electrical connection assembly of claim 1, wherein the first terminal and the second terminal are held in the insulating housing at such positions that the wire connection surface of the first terminal and the wire connection surface of the second terminal are displaced from each other in the longitudinal direction of the first wire and the second wire, and the bulging portion of the connecting member to be applied to the first terminal bulges in a direction parallel to the wire arrangement direction from the wire connection surface of the first terminal and is fixed directly to the conductor of the second wire.

3. The electrical connection assembly of claim 1, wherein the second connecting member includes a bulging portion bulging in a direction toward the first wire from the wire connection surface of the second terminal in addition to the bulging portion of the first connecting member, and the bulging portion of the second connecting member is fixed directly fixed to the conductor of the first wire.

4. An electrical connection assembly, comprising:

wires each including a conductor;

terminals respectively corresponding to the wires;

connecting members made of solder and respectively applied to the terminals; and an insulating housing collectively holding the terminals arranged in a wire arrangement direction orthogonal to a longitudinal direction of the wires such that the wires are conductively connectable to the terminals respectively via the connecting members while being arranged at intervals in the wire arrangement direction;

wherein:

each of the terminals includes a wire connection surface connectable respectively to the conductors of each of the wires, the connecting members being fixed respectively on the wire connection surfaces;

the wires include a first wire and a second wire to be electrically connected to one another;

the terminals include a first terminal and a second terminal respectively corresponding to the first wire and the second wire;

the connecting members include a first connecting member to be applied to the first terminal and a second connecting member to be applied to the second terminal;

the first connecting member includes a bulging portion bulging toward the second wire from the wire connection surface of the first terminal and to be electrically connected to the conductor of the second wire; and the bulging portion of the first connecting member bulges in a direction toward the second terminal from the wire connection surface of the first terminal and is fixed to the second terminal or the second connecting member.

5. The electrical connection assembly of claim 4, wherein the first connecting member and the second connecting member are integrated to constitute a single connecting member.

6. A method for manufacturing an electrical connection assembly having wires each of which includes a conductor, the wires including a first wire and a second wire that are to be connected electrically to one another, the method comprising:

a connector preparing step of preparing a connector including terminals respectively corresponding to the wires and including a first terminal corresponding to the first wire and a second terminal corresponding to the second wire, connecting members made of solder and to be applied respectively to the terminals and including a first connecting member to be applied to the first terminal and a second connecting member to be applied to the second terminal, and an insulating housing for collectively holding the terminals arranged in a wire arrangement direction orthogonal to a longitudinal direction of the wires such that the wires are conductively connectable to the terminals respectively via the connecting members while being arranged at intervals in the wire arrangement direction, the first connecting member including a bulging portion bulging toward the second wire from the wire connection surface of the first terminal;

a terminal connecting step of electrically connecting parts of the wires and wire connection surfaces corresponding thereto via the connecting members by heating and melting the connecting members while respectively bringing the wires into contact with the connecting members with the wires arranged at intervals from each other in the wire arrangement direction; and a conductor connecting step of connecting the conductor of the first wire to the conductor of the second wire via the first connecting member by heating and melting the bulging portion of the first connecting member.

7. The method of claim 6, wherein the terminal connecting step for the first wire and the first terminal via the first connecting member and the conductor connecting step are performed simultaneously by heating the first connecting member.

8. The method of claim 6, wherein the connector preparing step includes forming the first connecting member with the bulging portion by plastically deforming the first connecting member with the first connecting member fixed to the wire connection surface of the first terminal.

9. The method of claim 8, wherein the bulging portion is formed after the terminals are held in the insulating housing.

10. The method of claim 6, wherein the connector in which the bulging portion of the first connecting member is shaped to directly contact the conductor of the second wire is prepared in the connector preparing step, and the bulging portion is heated and directly fixed to the conductor of the second wire while being directly in contact with the second wire in the conductor connecting step.

11. The method of claim 10, further comprising holding the first and second terminals in the insulating housing at such positions that the wire connection surface of the first terminal and the wire connection surface of the second terminal are displaced from each other in the longitudinal direction of the first and second wires and such that the bulging portion of the connecting member to be applied to the first terminal bulges in a direction parallel to the wire arrangement direction from the wire connection surface of the first terminal is prepared in the connector preparing step, and the bulging portion is fixed to the conductor of the second wire at a position deviating in the longitudinal direction from the wire connection surface of the second terminal in the conductor connecting step.

12. The method of claim 10, further comprising forming the second connecting member to include a bulging portion bulging toward the first wire from the wire connection surface of the second terminal in addition to forming the bulging portion of the first connecting member is prepared in the connector preparing step, and the bulging portion of the second connecting member is directly fixed to the conductor of the first wire in the conductor connecting step.

13. The method of claim 6, forming the bulging portion of the first connecting member to bulge toward the second terminal from the wire connection surface of the first terminal is prepared in the connector preparing step, and then fixing the bulging portion to the second terminal or the second connecting member by being heated and melted in the conductor connecting step.

14. The method of claim 13, wherein the conductor connecting step includes integrating the first connecting member and the second connecting member to form a single connecting member by heating and melting both the first connecting member and the second connecting member.

15. The method of claim 14, further comprising forming the second connecting member to include a bulging portion bulging toward the first connecting member from the wire connection surface of the second terminal is prepared in the connector preparing step, and the conductor connecting step includes mutually integrating the bulging portions to form the connecting member by heating the bulging portions of the first connecting member and the second connecting member.

* * * * *